US007115170B2

(12) United States Patent
Blackmon

(10) Patent No.: US 7,115,170 B2
(45) Date of Patent: Oct. 3, 2006

(54) PORTABLE BULK PRODUCT MELT SYSTEM

(75) Inventor: James E. Blackmon, La Grange Park, IL (US)

(73) Assignee: Superior Bulk Logistics, Inc., Oak Brook, IL (US)

( * ) Notice: Subject to any disclaimer, the term of this patent is extended or adjusted under 35 U.S.C. 154(b) by 78 days.

(21) Appl. No.: 10/697,384

(22) Filed: Oct. 30, 2003

(65) Prior Publication Data

US 2004/0089247 A1 May 13, 2004

Related U.S. Application Data

(60) Provisional application No. 60/422,241, filed on Oct. 30, 2002.

(51) Int. Cl.
*C13F 1/00* (2006.01)

(52) U.S. Cl. ..... 127/22; 127/1

(58) Field of Classification Search ..... 127/1, 127/2, 22; 210/241; 137/899
See application file for complete search history.

(56) References Cited

U.S. PATENT DOCUMENTS 3,480,476 A * 11/1969 Abbott ..... 127/1
3,901,724 A * 8/1975 White ..... 127/22
3,939,005 A * 2/1976 White ..... 127/63
4,046,689 A * 9/1977 Argyll ..... 71/12
4,063,960 A * 12/1977 Paley ..... 127/42
4,526,621 A * 7/1985 Fields et al. ..... 127/1
5,114,489 A * 5/1992 Milner et al. ..... 127/2
5,702,746 A * 12/1997 Wiik ..... 426/248
5,893,947 A * 4/1999 Pease et al. ..... 127/46.2
6,007,597 A * 12/1999 Puopolo et al. ..... 75/10.14
6,551,643 B1 * 4/2003 Bernatz et al. ..... 426/516

* cited by examiner

*Primary Examiner*—Derek S. Boles
(74) *Attorney, Agent, or Firm*—Pauley Petersen & Erickson

(57) ABSTRACT

A bulk product melt system including a portable support platform positionable with respect to a bulk product source vessel. A water heating system is positioned with respect to the support platform and includes a water tank, which contains a volume of water heated to a selected process water temperature. A water flowmeter in control communication with the water tank monitors a water flowmeter rate of the heated water from the water tank. A mixing eductor in fluidic communication with the water tank receives the heated water at a controlled water flowmeter rate from the water tank. The portable bulk product melt system also includes a bulk product mixing system that is positioned with respect to the portable support platform and includes a bulk product receiver having an inlet portion in fluidic communication with an outlet of the bulk product source vessel and an outlet portion in fluidic communication with the mixing eductor. The bulk product receiver receives bulk product from the bulk product source vessel and discharges the bulk product into the mixing eductor through a continuous weigher. Within the mixing eductor, the bulk product is mixed with the heated water to produce a melted product mixture. The melted product mixture is discharged from the mixing eductor into an inlet of the bulk product source vessel in discharge communication with the mixing eductor.

24 Claims, 1 Drawing Sheet

PORTABLE BULK PRODUCT MELT SYSTEM

CROSS REFERENCE TO RELATED APPLICATION

This application claims the benefit of U.S. Provisional Application No. 60/422,241 filed 30 Oct. 2002.

BACKGROUND OF THE INVENTION

1. Field of the Invention

This invention relates generally to a portable bulk product melt system and, more specifically, to a portable bulk product melt system having a bulk product mixing system which receives a bulk product from a bulk product source vessel, wherein the bulk product is offloaded then treated to form a melted product mixture and then discharged back into the bulk product source vessel.

2. Description of Prior Art

Many conventional bulk product melt systems require bulk product to be deliver in a container, such as a truck tanker, railroad car tank, or temporary storage tank, to a factory or off-site building having a mixing station or system. The bulk product is transferred into the mixing station or system and mixed with various ingredients or materials to produce or process a mixture. The mixture is than transferred into a second container, such as a second truck tanker or second railroad car tank, for storage and/or transporting the mixture to another location. This process may include costly and unnecessary movement and handling of the bulk product.

Therefore, there exists a need for a portable bulk product melt system that is transportable to and positionable with respect to a bulk product source.

There exists a need for a portable bulk product melt system that can process a bulk product received from a bulk product source vessel into a treated product mixture and discharge the treated product mixture back into the bulk product source vessel.

SUMMARY OF THE INVENTION

A general object of the invention is to provide a portable bulk product treatment system.

It is another object of this invention to provide a portable bulk product melt system having a hot water heating system and a bulk product mixing system each independently positioned and/or mounted with respect to a support platform of the portable bulk product melt system and in fluidic communication with a mixing eductor.

It is another object of this invention to provide a portable bulk product melt system, wherein the bulk product mixing system receives from a bulk product source vessel a bulk product, and the bulk product is mixed within a mixing eductor with heated water from the hot water heating system to form a melted product mixture, which is discharged back into the bulk product source vessel.

The general object of the invention can be attained, at least in part, through a portable bulk product melt system including a support platform that is positionable with respect to a bulk product source vessel. A hot water heating system is independently positioned and/or mounted with respect to the support platform and includes a water tank containing a volume of water that can be heated to a selected process water temperature. The hot water heating system includes a heat source operatively connected to a heat exchanger at a first end portion and a second end portion of the heat exchanger is operatively connected to the water tank to provide heat transfer communication between the heat source and the volume of water contained within the water tank. Preferably, a water temperature controller is operatively connected to the heat source and programmable to heat the volume of water contained within the water tank to the selected process water temperature.

The heated water moves from the water tank to a mixing eductor in fluidic communication with the water tank, wherein the heated water mixes with a bulk product, such as sugar, and melts the bulk product to produce a melted product mixture. Preferably, the melted product mixture contains components in a selected or determined fixed proportion. As the heated water moves through a line to the mixing eductor, a water flowmeter in control communication with the water tank monitors a water flowmeter rate of the heated water. The mixing eductor receives the heated water at a selected or controlled water flowmeter rate from the water tank.

A bulk product mixing system is positioned and/or mounted with respect to the support platform and includes a bulk product receiver having an inlet portion in fluidic communication with an outlet of the bulk product source vessel and an outlet portion in fluidic communication with the mixing eductor. The bulk product receiver discharges the bulk product into the mixing eductor to be mixed with the heated water to produce the melted product mixture. The melted product mixture is then discharged into an inlet of the bulk product source in discharge communication with the mixing eductor.

The invention further comprehends a method for producing a treated or melted bulk product mixture using a portable bulk product treatment system, wherein a bulk product is transferred from a bulk product source to a bulk product receiver. Preferably, the bulk product is sugar. However, it should be apparent that other suitable bulk products may be processed using the apparatus and method of the present invention to produce a treated bulk product mixture. The bulk product source vessel can be a truck tanker, a process storage tank, a permanent storage tank or any other suitable transporting and/or storage container. The bulk receiver discharges the bulk product into a continuous weigher, in discharge communication with the bulk receiver, wherein the bulk product is continuously weighed to determine a bulk product total weight.

The weighed bulk product is discharged from the continuous weigher into a mixing eductor and mixed within the mixing eductor with heated water having a selected process water temperature. Preferably, the bulk product is mixed with the heated water at a preset or selected mixing rate. The water is heated to the selected process water temperature using a hot water heating system having a heat exchanger that provides heat exchange communication between a volume of water contained within a water tank and a heat source. The process water temperature within the water tank is preferably monitored to prevent the hot water heating system from overheating. Upon mixing the bulk product with the heated water, the bulk product is melted to form the melted product mixture. The melted product mixture is then discharged into the bulk product source vessel.

In one preferred embodiment of this invention, the process water temperature is verified or confirmed before the bulk product is mixed with the heated water within the mixing eductor. Additionally, a flowmeter positioned with respect to the water tank monitors the water flowmeter rate from the water tank to the mixing eductor. The heated water can be pumped through an ultraviolet microbial sanitizer preferably before entering the mixing eductor.

In one preferred embodiment of this invention, upon meeting a bulk product weight set point, and verification of the bulk product weight set point, the portable bulk product melt system is stopped or operation of the portable bulk product melt system continues until a second bulk product weight set point is met and verified.

Other objects and advantages will be apparent to those skilled in the art from the following detailed description taken in conjunction with the appended claims and drawings.

DETAILED DESCRIPTION OF THE INVENTION

Figure 1:
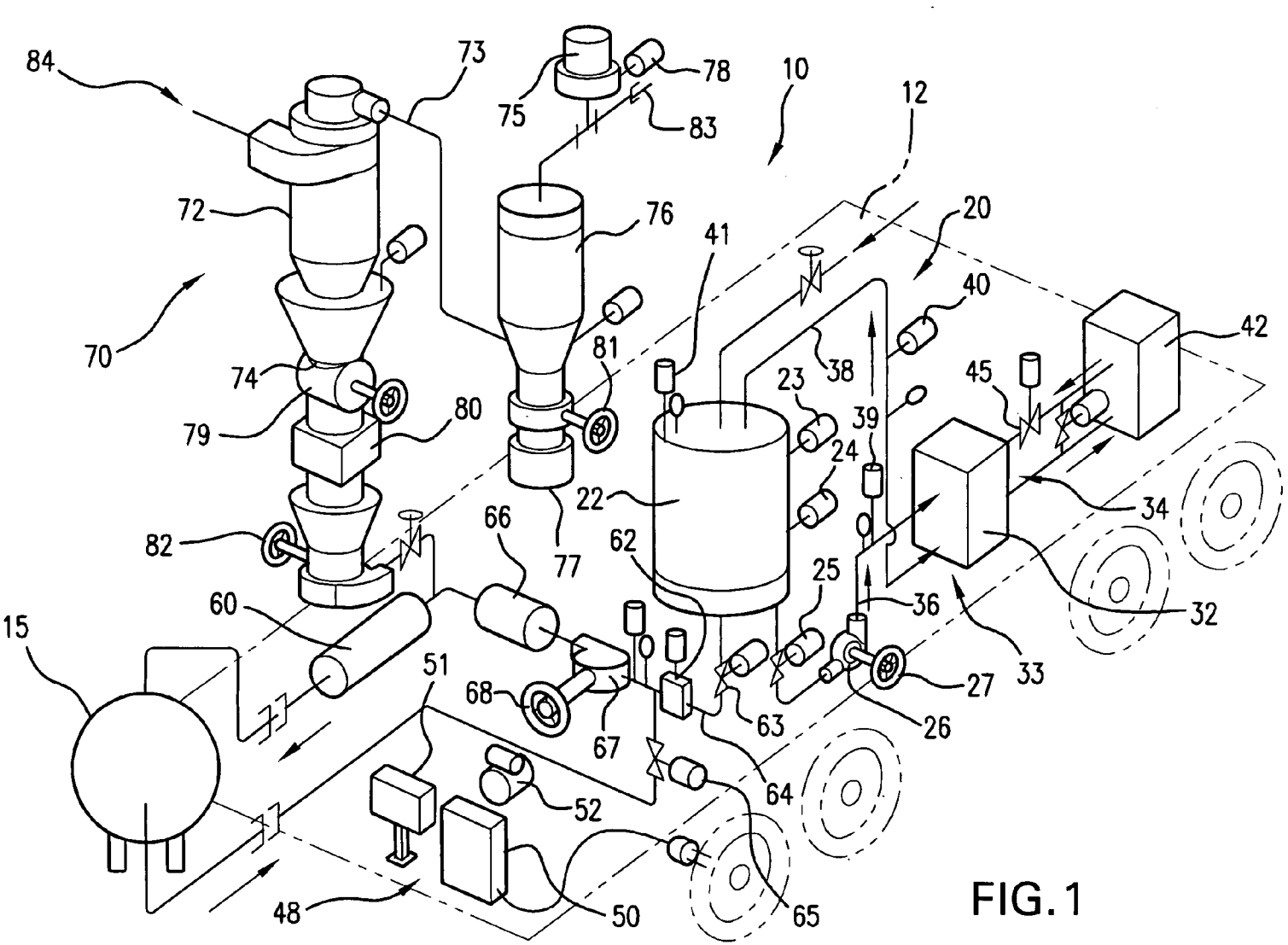
FIG. 1 is a schematic drawing of a portable bulk product melt system, according to one preferred embodiment of this invention.

Referring to FIG. 1, the present invention provides a portable bulk product melt system 10 comprising a portable support platform 12 movable and/or positionable with respect to a bulk product source vessel 15. Bulk product source vessel 15 may comprise a railroad car, a truck tanker, a temporary processing tank or a permanent storage tank for example. In one preferred embodiment of this invention, support platform 12 may comprise a railroad car or a flatbed trailer and correspondingly be secured to a locomotive or transporting truck and movable into proximity with bulk product source vessel 15 by operating and parking the support platform 12, such as a transporting truck or railroad car, with respect to bulk product source vessel, such as a second railroad car or a permanent storage tank. Although throughout this specification the bulk product is sugar, the portable bulk product melt system of the present invention may be suitable for processing, treating and/or melting other bulk products or materials.

In one preferred embodiment of this invention, a hot water heating system 20 is positioned and/or mounted with respect to support platform 12. Hot water heating system 20 is preferably independently mounted on support platform 12 for transporting hot water heating system 20. Hot water heating system 20 comprises a water tank 22, which contains a volume of water that is preferably heated to a selected process water temperature. Preferably, the volume of water is heated to a process water temperature of about 130° C. to about 180° C., more preferably about 140° C. to about 160° C. Water tank 22 includes a high level switch 23 and a low level switch 24 which are activated to signal that the water volume within water tank 22 is either high or low, respectively. A heat exchanger 32 is operatively connected at a first end portion 33 to the water tank 22. An outlet valve 25 operates to control water flow between water tank 22 and heat exchanger 32. A pump 26 driven by a motor 27 pumps water through a line 36 from water tank 22 to heat exchanger 32.

A heat source 42 is operatively connected at a second end portion 34 of heat exchanger 32. It is apparent to those skilled in the art and guided by the teachings herein provided that any suitable heat source known to those skilled in the art can be used to provide sufficient heat to heat exchanger 32 to heat the water circulated between water tank 22 and heat exchanger 32 to a desired process water temperature. A heat source valve 45 controls communication between heat source 42 and heat exchanger 32. Heat exchanger 32 provides heat transfer communication between heat source 42 and the volume of water circulated between water tank 22 and heat exchanger 32. The water is preferably circulated through line 36 from water tank 22 to heat exchanger 32 and through line 38 from heat exchanger 32 to water tank 22. Lines 36, 38 preferably comprise any suitable plumbing, such as a flexible tube or hose or a rigid pipe. Such suitable plumbing is known in the art. Preferably, temperature gauges 39, 40 are be positioned with respect to lines 36, 38, respectively, to monitor the temperature of the water entering and exiting heat exchanger 32. Additionally, a temperature gauge 41 can be positioned with respect to water tank 22 to monitor the temperature of the volume of water contained within water tank 22.

In one preferred embodiment of this invention, portable bulk product melt system 10 comprises a water temperature controller 48 operatively connected to and in controlling communication with heat exchanger 32 and/or heat source 42. Water temperature controller 48 is programmable to heat the water circulating between water tank 32 and heat exchanger 32 to the selected process water temperature. When the circulating water reaches the selected process water temperature, hot water heating system 20 can be temporarily shut down to prevent overheating of hot water heating system 20. Preferably, water temperature controller 48 is electrically connected to a local power supply using a conventional electric cord. Water temperature controller 48 comprises a motor control center 50, a control panel 51 and an air compressor 52 for selecting and controlling the process water temperature.

Water tank 22 is operatively connected to and in fluidic communication with a mixing eductor 60. Heated water flows from water tank 22 through an isolation valve 63 into mixing eductor 60 via a line 64. Similar to lines 36, 38, line 64 preferably comprises suitable plumbing, such as a flexible hose or a rigid pipe. Mixing eductor 60 receives the heated water at a controlled flow rate from water tank 22. In one preferred embodiment of this invention, a water flowmeter 62 is positioned between water tank 22 and mixing eductor 60 and in control communication with water tank 22. Water flowmeter 62 monitors a water flowmeter rate of heated water from water tank 22 to mixing eductor 60 and controls the water flowmeter rate to maintain the water flowmeter rate at a generally constant, selected flow rate. Preferably, the water flowmeter rate is about 100 gallons per minute (GPM) to about 150 GPM, more preferably about 125 GPM to about 135 GPM. Within mixing eductor 60, bulk product, such as sugar, received from bulk product system 70, discussed below, is mixed with the heated water from water tank 22 and melted to produce a melted product mixture.

In one preferred embodiment of this invention, isolation valve 63 remains open until a selected water flowmeter rate at flowmeter 62 is achieved. Upon reaching the selected water flowmeter rate, isolation valve 63 closes and a valve 65 opens to provide fluidic communication between bulk product source vessel 15 and line 64. With valve 65 open, the melted product mixture produced by portable bulk product melt system 10 can be recirculated through line 64 from bulk product source vessel 15 and passed through an ultraviolet microbial sanitizer 66 and into mixing eductor 60. A water recirculation pump 67 is positioned with respect to line 64 to pump or recirculate the melted sugar concentrate mixture through mixing eductor 60. Preferably, water recirculation pump 67 is driven by a motor 68. Sugar or other product is further controlled, as to viscosity or temperature for example, by switching valve 65 and 63, thereby adding additional fluid to the product and controlling the amount of fluid through flowmeter 62 until the desired properties are achieved. By again switching valves 63 and 65, further product mixing and product addition through mixing eductor 60 can also be achieved.

Portable bulk product melt system 10 further comprises a bulk product mixing system 70 positioned and/or mounted with respect to support platform 12. Bulk product mixing system 70 is preferably independently mounted on support platform 12 and operatively connected with mixing eductor 60. Bulk product mixing system 70 comprises a bulk product receiver 72 having a motive air force connection inlet end portion 73 operatively connected to bulk product source vessel 15 through source line 84 and an outlet end portion 74 operatively connected to mixing eductor 60. Bulk product receiver 72 receives from bulk product source vessel 15 through source line 84 a supply of bulk product, such as sugar. Preferably, the bulk product is continuously unloaded from bulk product source vessel 15 through source line 84 into bulk product receiver 72 and filter receiver 76 using a vacuum exhauster 83 or other suitable device or machinery designed to provide the vacuum-motive force to convey the product from the source vessel 15 through source line 84 by and through bulk product receiver 72 for discharge to processing. In one preferred embodiment of this invention, clean air moves through a secondary filter receiver 76 to vacuum exhauster 83. Any sugar carry over from primary bulk product receiver 72 is picked up in filter receiver 76 prior to discharge through vacuum exhauster 83 to prevent product discharge to atmosphere. Product collected in filter receiver 76 is discharged through isolation valve 81 to the storage container 77.

Bulk product mixing system 70 is started after a water flowmeter rate and a product total weight is selected. Upon starting bulk product mixing system 70, a vacuum breaker valve 78 is closed and bulk product flows through product receiver 72 and an airlock valve 79 connected between bulk product receiver 72 and a continuous weigher 80. Continuous weigher 80 is in fluidic communication with product receiver 72, and in discharge communication with mixing eductor 60. Preferably, the bulk product is continuously discharged through outlet end portion 74 of bulk product receiver 72 through airlock valve 79 and into continuous weigher 80, wherein the bulk product is weighed and discharged through an eductor manual valve 82 and into mixing eductor 60. Mixing eductor 60 mixes the bulk product, such as sugar, with the heated water received within mixing eductor 60 from water tank 22 and the bulk product is melted to form the melted product mixture, for example a melted sugar mixture. The melted product mixture is then discharged into bulk product source vessel 15, such as a truck tanker, for storage and/or transporting. Preferably, mixing eductor 60 is in discharge communication with an inlet portion of bulk product source 15 for receiving the melted product mixture from mixing eductor 60.

In one preferred embodiment of this invention, the melted product mixture can be reintroduced into portable sugar melt system 10 by opening valve 65 and closing isolation valve 63. The melted product mixture is recirculated through line 64 through ultraviolet microbial sanitizer 66 and into mixing eductor 60. As discussed above, sugar or other bulk product is further controlled, as to viscosity or temperature by switching valve 65 and 63, thereby adding additional fluid to the product and controlling the amount of fluid through flowmeter 62 until the desired properties are achieved. By again switching valves 63 and 65, further product mixing and product addition through mixing eductor 60 can also be achieved.

Referring to FIG. 1, in one preferred embodiment of this invention, a melted product mixture is produced using portable bulk product melt system 10, wherein a bulk product, such as sugar, is transferred from bulk product source vessel 15 through source line 84 to bulk product receiver 72 positioned on support platform 12, such as, in the illustrated example, a truck flatbed trailer. Vacuum breaker valve 78 is closed and bulk product moves or flows through product receiver 72 into continuous weigher 80, wherein the bulk product is weighed to determine a selected bulk product total weight. The weighed bulk product is then moved through manual eductor valve 82 and into mixing eductor 60. Within mixing eductor 60, the bulk product is mixed with heated water having a desired or selected process water temperature.

As discussed above, a volume of water contained within water tank 22 is heated to a desired or selected process water temperature as the water is passed through heat exchanger 32. As the heated water moves through line 64 from water tank 22 into mixing eductor 60, the flow of heated water to the mixing eductor is monitored. In one preferred embodiment of this invention, flowmeter 62 monitors the water flowmeter rate. Additionally, the process water temperature within water tank 22 can be monitored to prevent hot water heating system 20 from overheating and to verify a correct temperature to assure proper mixing and melting of the bulk product, before the heated water is introduced into mixing eductor 60 for mixing with and melting the bulk product. Preferably, the heated water passes through ultraviolet microbial sanitizer 66 before the heated water enters mixing eductor 60.

Within mixing eductor 60, the bulk product is mixed with the heated water and melted by the heated water to form the melted product mixture. Preferably, the bulk product is mixed with the heated water at a preset rate. Further, the mixture components are preferably selected to comprise a fixed proportion of the melted product mixture. The melted product mixture is discharged into bulk product source vessel 15. In one preferred embodiment of this invention, the heated water is recirculated into portable bulk product melt system 10 upon reaching a determined water flowmeter rate.

In one preferred embodiment of this invention, upon meeting a bulk product weight set point, the bulk product weight set point is verified and portable bulk product melt system 10 is stopped or operation of portable bulk product melt system 10 continues to meet a second bulk product weight set point, upon verification of the melted product mixture. The second bulk product weight set point is then verified. Upon verification of the melted product mixture of the second bulk product weight set point, portable bulk product melt system 10 is stopped or operation continues to meet a third bulk product weight set point.

Thus, the present invention provides a portable bulk product melt system comprising a hot water heating system and a bulk product mixing system, each independently positioned and/or mounted on a support platform that is positionable with respect to a bulk product source vessel. The hot water heating system provides heated water to the mixing eductor as the bulk product system provides a bulk product, such as sugar, to the mixing eductor. Within mixing eductor 60, the bulk product is mixed with the heated water and melted to form a melted product mixture. The melted product mixture is then discharged from the mixing eductor and stored in the bulk product source vessel. The present invention also provides a method for producing a melted product mixture, using the portable bulk product melt system.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A bulk product melt system comprising:

a portable support platform positionable with respect to a bulk product source vessel;

a hot water heating system positioned with respect to the portable support platform and including a water tank, the water tank containing a volume of water heated to a selected process water temperature;

a mixing eductor in fluidic communication with the water tank and receiving the heated water at a controlled water flowmeter rate from the water tank;

a water flowmeter positioned between the water tank and the mixing eductor, the water flowmeter in control communication with the water tank and monitoring a water flowmeter rate of the heated water from the water tank to the mixing eductor and controlling the water flowmeter rate at a selected flowmeter rate;

a bulk product receiver having an inlet portion in fluidic communication with an outlet of the bulk product source vessel;

a continuous weigher in fluidic communication with an outlet portion of the product receiver and in discharge communication with the mixing eductor, a bulk product discharged from the bulk product receiver into the continuous weigher, the bulk product weighed in the continuous weigher and discharged into the mixing eductor, the bulk product mixed within the mixing eductor with the heated water to produce a melted product mixture; and an inlet of the bulk product source vessel in discharge communication with the mixing eductor, the bulk product source vessel inlet receiving the melted product mixture from the mixing eductor.

2. The bulk product melt system of claim 1 wherein the hot water heating system comprises:

a heat source;

a heat exchanger having a first end portion operatively connected to the heat source and a second end portion operatively connected to the water tank, the heat exchanger providing heat transfer communication between the heat source and the volume of water contained within the water tank; and a water temperature controller operatively connected to the heat source and programmable to heat the volume of water contained within the water tank to the selected process water temperature.

3. The bulk product melt system of claim 1 wherein the bulk product source vessel comprises one of a railroad car, a truck tanker, a temporary processing tank or a permanent storage tank.

4. The bulk product melt system of claim 1 further comprising an ultraviolet microbial sanitizer in fluidic communication with the water tank.

5. A bulk product melt system for treating a bulk product source comprising:

a water tank containing a volume of water heated to a selected process water temperature, the water tank positioned on a portable support platform, the support platform positionable with respect to the bulk product source;

a water flowmeter in control communication with the water tank and monitoring a water flowmeter rate of water from the water tank;

a mixing eductor in fluidic communication with the water tank, at least a portion of heated volume of water received within the mixing eductor from the water tank at a selected water flowmeter rate controlled by the water flowmeter;

a bulk product receiver having an inlet portion in fluidic communication with an outlet of the bulk product source and an outlet portion in fluidic communication with a continuous weigher, a bulk product discharged from the bulk product receiver into the continuous weigher, the bulk product weighed in the continuous weigher and discharged into the mixing eductor, the bulk product mixed within the mixing eductor with the heated water to produce a melted product mixture; and an inlet of the bulk product source in discharge communication with the mixing eductor, the bulk product source inlet receiving the melted product mixture as the melted product mixture is discharged from the mixing eductor.

6. The bulk product melt system of claim 5 further comprising:

a heat source; and a heat exchanger providing heat transfer communication between the heat source and the volume of water contained within the water tank.

7. The bulk product melt system of claim 6 further comprising a water temperature controller operatively connected to the heat source and programmable to heat the volume of water contained within the water tank to the selected process water temperature.

8. The bulk product melt system of claim 5 wherein the process water temperature is about 130° C. to about 180° C.

9. The bulk product melt system of claim 5 wherein the water flowmeter rate is about 100 GPM to about 150 GPM.

10. A method for producing a melted bulk product mixture comprising the steps of:

moving a portable support platform into proximity with a bulk product source vessel;

transferring a bulk product from the bulk product source vessel to a bulk product receiver on the portable support platform;

weighing the bulk product in a continuous weigher to determine a bulk product total weight;

transferring the weighed bulk product from the continuous weigher to a mixing eductor for mixing with heated water;

supplying heated water from a water tank to the mixing eductor at a selected water flowmeter rate;

mixing the bulk product within the mixing eductor with heated water;

melting the bulk product with the heated water to form the melted product mixture; and discharging the melted product mixture into the bulk product source vessel.

11. The method of claim 10 wherein the bulk product source vessel comprises one of a railroad car, a truck tanker, a temporary processing tank or a permanent storage tank.

12. The method of claim 10 wherein the portable source platform comprises one of a railroad car and a truck flatbed.

13. The method of claim 10 further comprising the step of verifying the process water temperature before mixing the heated water with the bulk product.

14. The method of claim 10 further comprising the step of selecting a water flowmeter rate and a bulk product total weight.

15. The method of claim 10 further comprising the step of recirculating the heated water upon reaching a determined water flowmeter rate.

16. The method of claim 14 wherein a flow meter monitors the water flowmeter rate.

17. The method of claim 10 further comprising the step of pumping the heated water through an ultraviolet microbial sanitizer and into the mixing eductor.

18. The method of claim 10 wherein the bulk product is mixed with the heated water at a preset rate.

19. The method of claim 10 further comprising the step of monitoring the flow of heated water to the mixing eductor.

20. The method of claim 10 further comprising the step of monitoring a process water temperature within the water tank to prevent the hot water heating system from overheating.

21. The method of claim 10 further comprising the step meeting a bulk product total weight set point.

22. The method of claim 21 further comprising the step of verifying the bulk product total weight set point.

23. The method of claim 22 further comprising one of stopping the portable bulk product melt system or continuing operation of the portable bulk product melt system to meet a second bulk product total weight set point, upon verification of the melted product mixture.

24. The method of claim 23 further comprising the step of verifying the second bulk product total weight set point.

* * * * *